US006747206B1

(12) United States Patent
Law

(10) Patent No.: US 6,747,206 B1
(45) Date of Patent: Jun. 8, 2004

(54) JUNCTION BOX AND BALLAST MODULE ASSEMBLY

(75) Inventor: Bruce A. Law, Pawtucket, RI (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 10/308,939

(22) Filed: Dec. 3, 2002

(51) Int. Cl.[7] ..... H01R 13/46

(52) U.S. Cl. ..... 174/53; 174/52.1; 174/61; 174/50; 362/368; 362/374; 361/674; 361/736; 361/740; 361/747

(58) Field of Search ..... 174/53, 52.1, 61, 174/50; 362/368, 374, 375; 361/674, 736, 740, 747

(56) References Cited

U.S. PATENT DOCUMENTS

| | | | | |
|---|---|---|---|---|
| 2,335,218 A | | 11/1943 | Vacha | |
| 2,489,245 A | | 11/1949 | Sola | |
| 2,702,378 A | | 2/1955 | Talty | |
| 3,247,368 A | | 4/1966 | McHugh | |
| 3,428,737 A | | 2/1969 | Pou | |
| 3,751,574 A | | 8/1973 | Fisher | |
| 4,393,435 A | | 7/1983 | Petrina | |
| 4,674,015 A | | 6/1987 | Smith | |
| 4,729,740 A | | 3/1988 | Crowe et al. | |
| 4,897,627 A | | 1/1990 | Van Wagener et al. | |
| 4,969,070 A | | 11/1990 | Costa | |
| 5,006,764 A | | 4/1991 | Swanson et al. | |
| 5,138,528 A | | 8/1992 | Altman et al. | |
| 5,253,152 A | | 10/1993 | Yang et al. | |
| 5,260,678 A | | 11/1993 | Van Wagener et al. | |
| 5,377,075 A | | 12/1994 | Schmid et al. | |
| 5,410,462 A | * | 4/1995 | Wolfe | 362/365 |
| 5,664,869 A | | 9/1997 | Bitton | |
| 5,715,808 A | * | 2/1998 | Wilhoite | 126/85 B |
| 5,720,540 A | | 2/1998 | Crown et al. | |
| 5,800,050 A | * | 9/1998 | Leadford | 362/296 |
| 5,845,988 A | | 12/1998 | Mandall | |
| 5,908,235 A | | 6/1999 | Petrozello et al. | |
| 6,102,550 A | | 8/2000 | Edwards, Jr. | |
| 6,133,529 A | * | 10/2000 | Gretz | 174/65 R |
| 6,290,375 B1 | * | 9/2001 | LeVasseur | 362/368 |
| 6,293,510 B1 | * | 9/2001 | Bradford et al. | 248/317 |

* cited by examiner

*Primary Examiner*—Dean A. Reichard
*Assistant Examiner*—Anton Harris
(74) *Attorney, Agent, or Firm*—John F. Salazar; James E. Cole; Middleton Reutlinger

(57) ABSTRACT

A junction box and ballast circuitry assembly including a ballast housing for attachment to the junction box. The junction box is provided with two opposed open ends, one of the ends being in alignment with a side of the ballast housing and the opposed open end being adaptable for electrical communication with a lighting fixture. The junction box is provided with brackets on opposed sides for alignment with outwardly extending tabs on opposite sides of the ballast assembly to receive a fastening bolt through the tab and an opening in the aligned bracket.

18 Claims, 4 Drawing Sheets

JUNCTION BOX AND BALLAST MODULE ASSEMBLY

BACKGROUND OF THE INVENTION

The present invention relates to ballast circuitry adaptable for mounting to an open end of a junction box and more particularly to a combination of a junction box with ballast circuitry.

In the design and development of fluorescent lighting fixtures, it has been common place for the design of these fixtures to include fluorescent lamps of varying wattages and lengths, as well as a plurality of lamps enclosed in a single fixture. Thus, there is an ever increasing need for the development of junction boxes which receive the electrical components therethrough for incorporating into the lighting fixtures as well as different sizes of ballast circuitry and the housings in which these ballast circuitries fit. Moreover, there is an ever increasing problem in the design of ballast housings enclosing ballast circuitry which are adaptable for combining with the ever increasing number of junction boxes to be used with lighting fixtures. In many instances, the designers of ballast circuitries and housings for the circuitry have run into problems with fitting the ballast circuitry and housings onto junction box doors and these doors have to be redesigned for reception of specific ballast housings. Furthermore, in a number of junction box designs, the junction boxes include doors and springs as means to adapt to the receipt of ballast housings which require extensive costs, extra tooling, and the like, as well as greater assembly lime in attaching the ballast housings to the junction boxes.

DETAILED DESCRIPTION OF THE INVENTION

Figure 2:
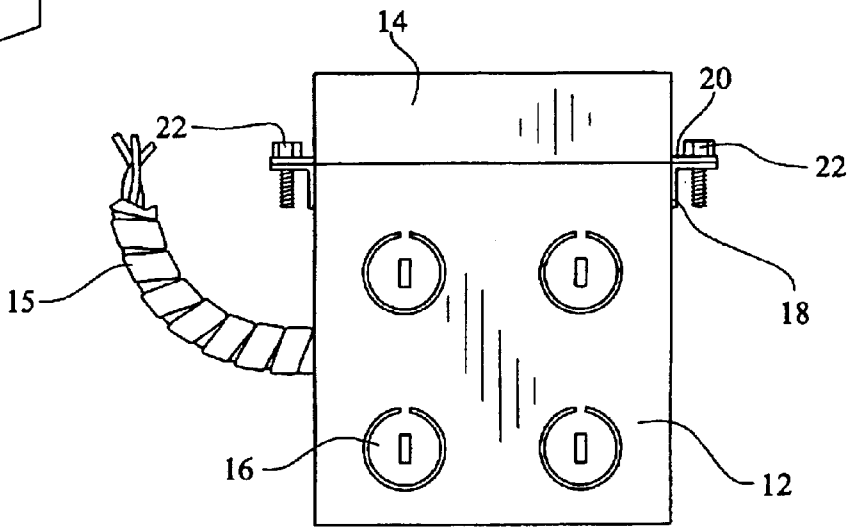
FIG. 2 is a top view of the junction box and ballast housing of FIG. 1.
Figure 1:
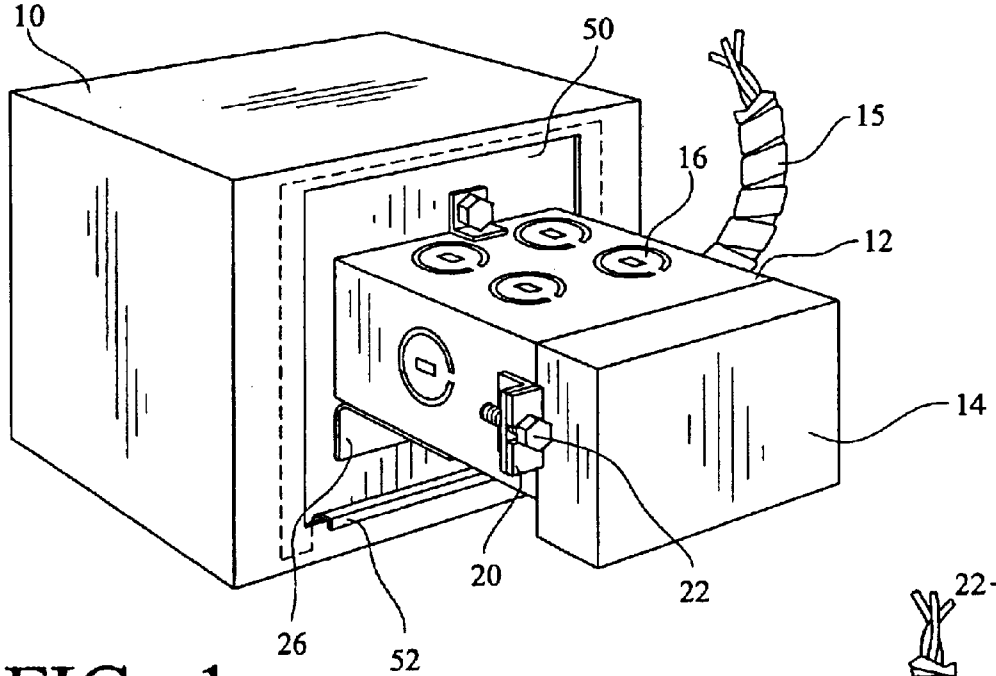
FIG. 1 is a perspective view of a junction box and ballast housing of the present invention.

As shown in FIG. 1, a ballast housing 14, including a ballast circuitry (not shown) therein, is attached to a junction box 12. The junction box 12 has a plurality of knock-out plugs 16 therein to receive electrical wires and the like therethrough and can also include wiring 15. The junction box 12 is attached to a light fixture housing as represented by the numeral 10 by way of a mounting plate 50.

As shown in FIGS. 1–4, the ballast housing 14, which may be metal, is provided with a pair of tabs 20 on opposite sides thereof with slots 24 therein to receive bolts 22 therethrough. The junction box 12 is provided with a pair of brackets 18 on opposite sides thereof in alignment with the tabs 20. The brackets 18 are provided with threaded openings 40 therein for alignment with the slots 24 to receive the threaded bolts 22 for attaching the ballast housing 14 onto the junction box 12.

Figure 3:
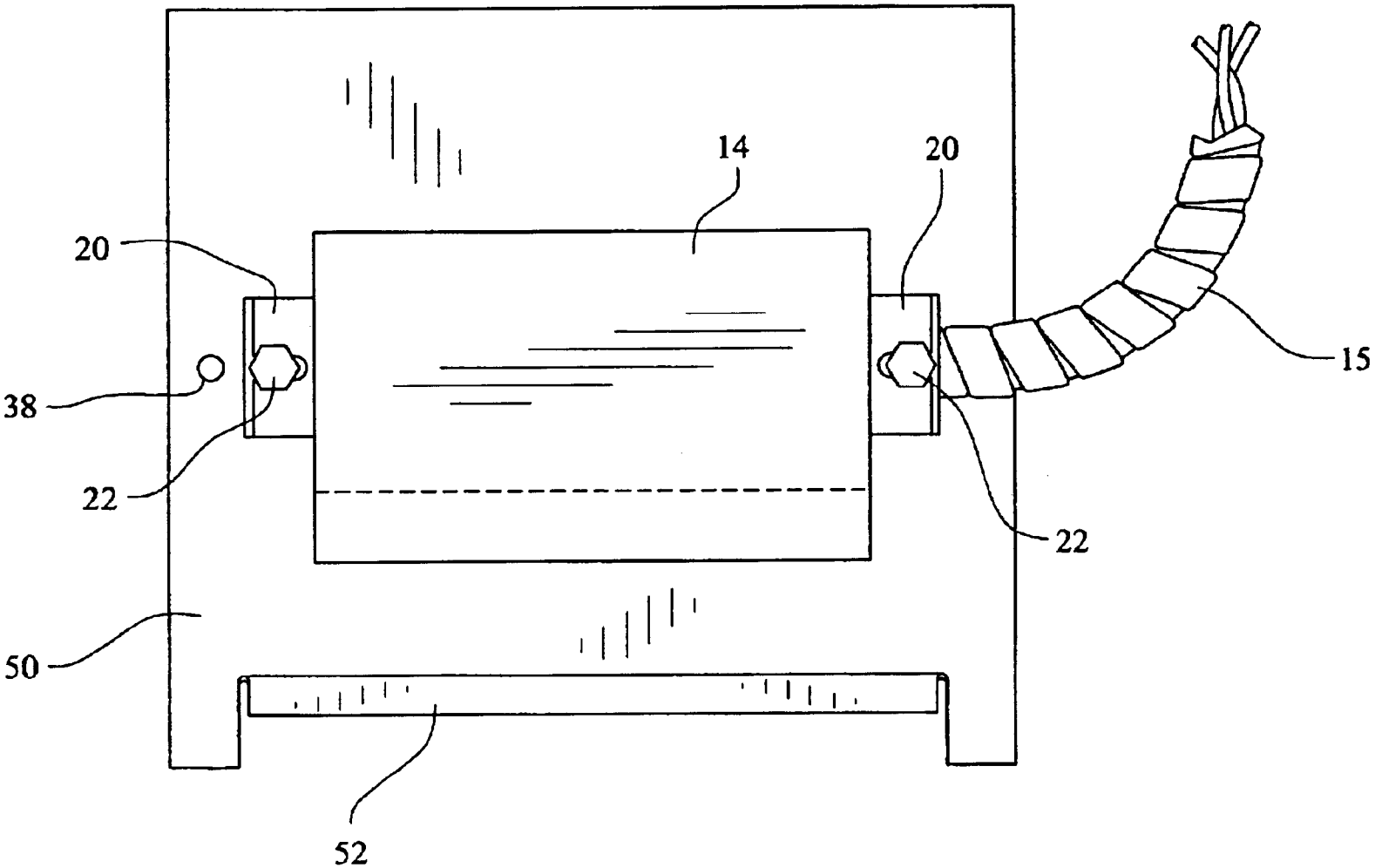
FIG. 3 is a side view of the junction box and ballast housing of FIG. 1 affixed to the mounting plate.
Figure 4:
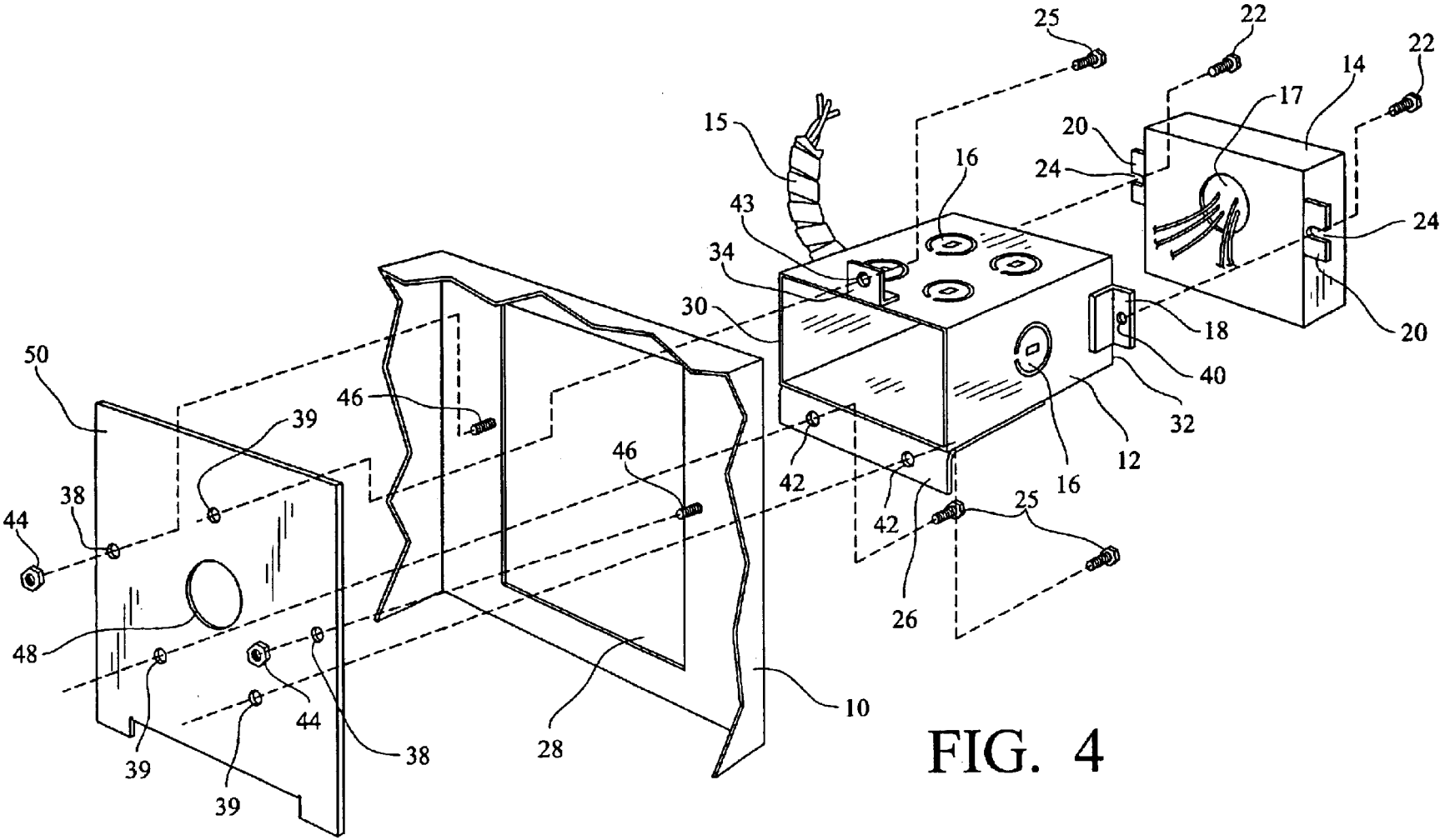
FIG. 4 is an exploded view of the junction box and ballast housing of FIG. 1.

A lighting fixture housing 10 is provided with a mounting plate 50 having a plurality of openings. In one embodiment, as best shown in FIG. 4, mounting plate 50 has a pair of openings 38 that line up with and engage a pair of threaded posts 46 affixed to the fixture housing 10. The mounting plate 50 can then be secured to the fixture housing 10 over an access opening 28 in the fixture housing 10 by passing the threaded posts 46 through the openings 38 and securing each with a fastener, for example, a hex nut 44. The mounting plate 50 can have dimensions greater than that of access opening 28 so that the mounting plate 50 can not pass through the access opening 28. The mounting plate 50 can also include a ledge 52, as shown in FIGS. 1 and 3, that helps to secure and support mounting plate 50 within fixture housing 10. The mounting plate 50 can further include a plurality of threaded openings 39 that line up with bracket openings 42 on an L-shaped bracket 26 for supporting the junction box 12 thereon and tab opening 43 on tab 34, all on an open end 30 of junction box 12. Threaded bolts 25 can be passed through openings 42 and 43 and threaded openings 39 to affix junction box 12 to mounting plate 50.

As shown in FIG. 4, the junction box 12 is provided with opposed open ends 30 and 32. The open end 30 is in alignment with both the access opening 28 into the lighting fixture housing 10 and a wiring opening 48 of mounting plate 50. The opposed open end 32 is in alignment with an opening 17 in the ballast housing 14 for receiving the electrical connections to the ballast circuitry housed within the ballast housing 14.

Figure 5:
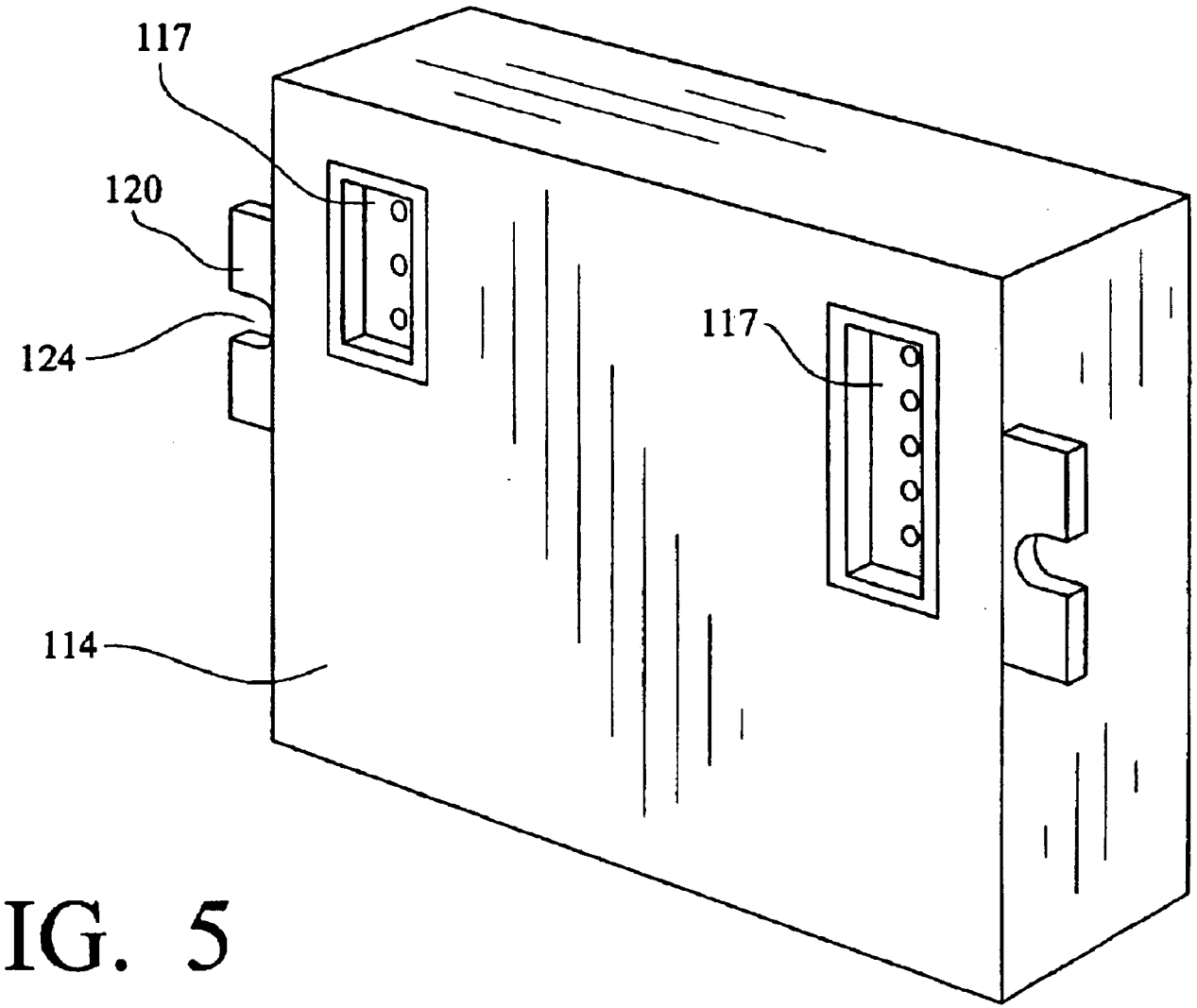
FIG. 5 is a perspective view of another embodiment of a ballast housing of the present invention.

Of course, the invention is not specific to a particular ballast housing 14 like that shown in FIG. 4. For example, FIG. 5 shows another ballast housing that will work equally well within the scope of the present invention. The ballast housing 114 shown in FIG. 5 is similar that the embodiment shown in the prior figures in overall dimensions. However, the ballast housing has push-in connectors 117 rather than loose wires for making wiring connections to the junction box 12 more easily. There are two sets of push-in connectors 117 shown in FIG. 5. However, different configurations are considered within the scope of the present invention as well. The ballast housing 114 can also include tabs 120 having slots 124 for affixing the ballast housing 114 to junction box 12.

As can be seen, the junction box 12 is capable of accepting a ballast housing. This solves the problem of trying to retrofit junction box doors so that the doors can accept ballast housings. Further, the combination junction box with ballast housing is easy to replace, relatively inexpensive, and requires less tooling and assembly time than presently marketed junction boxes and ballast housings.

In use, the attached ballast housing 14 and junction box 12 can be easily accessed through the access opening 28 of the fixture housing 10. This eliminates the necessity of completely removing the entire fixture, including the fixture housing 10, from its mounted location in order to access the junction box 12 or ballast housing 14 for repair or replacement. This feature is of particular value with lighting fixtures that, when installed, are difficult to service. For example, in recessed ceiling-mounted lighting fixtures, often the only practical access to the internal components of the fixture is through the fixture housing. Prior to the present invention, the only alternatives for servicing the ballast 14 or junction box 12 were to either remove a portion of the ceiling or pull the entire fixture from the ceiling.

Utilizing the present invention, a user can gain access to the ballast and junction box through the fixture housing 10. The user simply removes hex nuts 44 from threaded posts 46 and pulls the entire junction box/ballast assembly shown in FIG. 3 through the access opening 28 and into the fixture housing 10 (or even entirely out of the fixture housing 10), where it can be repaired or replaced.

The foregoing description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A junction box and ballast assembly comprising:

a junction box having a top, bottom, and two opposed sides, said junction box having a first open end;

a ballast housing having an end with an opening thee through, said end with said opening aligned with said junction box first open end thereby closing said junction box first open end;

said ballast housing directly connected to said first open end of said junction box.

2. The apparatus of claim 1, said junction box having a second open end opposed to said first junction box open end.

3. The apparatus of claim 1, said junction box having a bracket with an opening therein adjacent said junction box first open end and aligned with a slot in an outwardly extending tab of said ballast housing adjacent said ballast housing opening.

4. The apparatus of claim 3, said bracket and tabs being on opposite sides of said junction box and said ballast housing.

5. In combination with an electrical fixture housing having an electrical connection opening a junction box and ballast assembly comprising:

a junction box having a top, bottom, and two opposed sides, said junction box having a first open end and an opposed second open end;

a ballast housing having an end with at least one opening therethrough, said end with said opening aligned with said junction box first open end;

said ballast housing directly connected to said first open end of said junction box;

a mounting plate affixed to said second open end.

6. The combination of claim 5, said junction box having a bracket with an opening therein adjacent said junction box first open end and aligned with a slot in an outwardly extending tab of said ballast housing adjacent said ballast housing first open end.

7. The combination of claim 6, said bracket and tabs being on opposite sides of said junction box and said ballast housing.

8. The combination of claim 5, said at least one opening being a push-in connector.

9. The combination of claim 5, said electrical fixture housing having an access opening through a side wall and said mounting plate being affixed to an inside surface of said side wall over said access opening.

10. The combination of claim 9, said mounting plate having a wiring opening for passage of wiring between said fixture housing and said junction box.

11. The combination of claim 10, further comprising a plurality of threaded posts inwardly extending from said inside surface of said side wall of said electrical housing and said mounting plate having openings in alignment with said threaded posts such that said mounting plate is affixed to said electrical housing side wall on said threaded posts.

12. The combination of claim 11, said mounting plate affixed to said side wall by a plurality of fasteners fastened to said threaded posts.

13. The combination of claim 12, said fasteners being accessible from inside said lighting fixture housing.

14. The combination of claim 9, said access opening having dimensions less than those of said mounting plate.

15. A junction box in combination with a ballast housing, comprising:

a junction box having a top wall, bottom wall and opposing side walls, said junction box having a first open end and a second open end;

a ballast housing mateable with said second end of said junction box, said ballast housing forming a second end wall of said junction box;

said junction box having a bracket with an opening therein adjacent said junction box first open end and aligned with a slot in an outwardly extending tab of said ballast housing adjacent a ballast housing opening;

a mounting plate engageable with said first open end of said junction box and forming a first end wall for said junction box;

a fixture housing, said fixture housing having an open interior, said mounting plate affixed to an interior wall of said fixture housing.

16. A universally mountable open ended junction box, comprising:

a top wall, bottom wall and first and second opposing side walls;

a first mounting bracket affixed to said first side wall;

a second mounting bracket affixed to said second side wall;

said first mounting bracket on said first side wall and said second mounting bracket on said second side wall mounted on a second open end of said junction box;

a third mounting bracket affixed to said bottom wall, said third mounting bracket positioned adjacent said first open end of said junction box;

said second open end of said junction box mateable with a ballast housing, said ballast housing closing said second open end of said junction box when affixed to said junction box;

said first open end of said junction box mountable on a fixture housing, said first open end of said junction box closed after affixation of said junction box to said fixture housing.

17. A combination ballast and junction box, comprising:

a ballast housing having at least one surface with an opening therein;

a junction box having a top, a bottom, two opposed sides, and at least one open end;

said at least one ballast housing surface and said at least one open end of said junction box being integrally connected.

18. A combination ballast housing and junction box, comprising:

a junction box having a top, two opposed side depending from said top, and a bottom extending between said sides defining at least one opening in said junction box;

a ballast housing having at least one surface with an opening therein;

said at least one opening in said junction box and said at least one surface of said ballast housing directly combined to form an integral unit.

* * * * *